US010479101B2

(12) United States Patent
Inada et al.

(10) Patent No.: US 10,479,101 B2
(45) Date of Patent: Nov. 19, 2019

(54) LIQUID EJECTION HEAD AND RECORDING APPARATUS

(71) Applicant: CANON KABUSHIKI KAISHA, Tokyo (JP)

(72) Inventors: Genji Inada, Koshigaya (JP); Naozumi Nabeshima, Tokyo (JP); Soji Kondo, Yokohama (JP); Noriyasu Nagai, Tokyo (JP); Takuya Iwano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/014,624

(22) Filed: Jun. 21, 2018

(65) Prior Publication Data

US 2019/0001691 A1 Jan. 3, 2019

(30) Foreign Application Priority Data

Jun. 28, 2017 (JP) ..... 2017-126306

(51) Int. Cl.

| | |
|---|---|
| ***B41J 2/175*** | (2006.01) |
| ***B41J 2/14*** | (2006.01) |
| ***B41J 2/155*** | (2006.01) |
| ***B41J 2/185*** | (2006.01) |

(52) U.S. Cl.

CPC ..... *B41J 2/17563* (2013.01); *B41J 2/14* (2013.01); *B41J 2/155* (2013.01); *B41J 2/17596* (2013.01); *B41J 2/185* (2013.01); *B41J 2002/14403* (2013.01); *B41J 2202/12* (2013.01); *B41J 2202/20* (2013.01); *B41J 2202/21* (2013.01)

(58) Field of Classification Search

CPC .... B41J 2/17563; B41J 2/17596; B41J 2/185; B41J 2/155; B41J 2202/21; B41J 2202/20; B41J 2202/12; B41J 2/14233; B41J 2002/14403; B41J 2/14

See application file for complete search history.

(56) References Cited

U.S. PATENT DOCUMENTS

| | | | | |
|---|---|---|---|---|
| 5,296,875 | A * | 3/1994 | Suda | B41J 2/17563 347/89 |
| 6,116,727 | A * | 9/2000 | Hagiwara | B41J 2/175 347/89 |
| 8,529,040 | B2 * | 9/2013 | Yamamoto | B41J 2/17513 347/84 |
| 9,718,274 | B2 | 8/2017 | Inada et al. | |
| 9,770,911 | B2 | 9/2017 | Inada et al. | |

(Continued)

FOREIGN PATENT DOCUMENTS

| | | | | |
|---|---|---|---|---|
| EP | 2 347 905 | A2 | 7/2011 | |
| EP | 2347905 | A2 * | 7/2011 | B41J 2/175 |
| JP | 2011-224936 | A | 11/2011 | |

OTHER PUBLICATIONS

Extended European Search Report dated Nov. 2, 2018, in European Patent Application No. 18180021.0.

*Primary Examiner* — Kristal Feggins
(74) *Attorney, Agent, or Firm* — Venable LLP

(57) ABSTRACT

An element substrate has ejection ports for ejecting liquid, pressure chambers for storing the liquid to be ejected from the ejection ports, liquid supply paths for supplying liquid to the pressure chambers, and liquid recovery paths for recovering liquid from the pressure chambers. Filter chambers have respective filters for capturing foreign objects contained in liquid. Liquid is forced to flow upwardly from below relative to the filters.

8 Claims, 8 Drawing Sheets

(56) References Cited

U.S. PATENT DOCUMENTS

| | | | | |
|---|---|---|---|---|
| 9,962,937 | B2 | 5/2018 | Okushima et al. | |
| 9,975,346 | B2 | 5/2018 | Amma et al. | |
| 10,022,979 | B2 | 7/2018 | Okushima et al. | |
| 2011/0242237 | A1* | 10/2011 | Uezawa | B41J 2/14233 347/89 |
| 2017/0197409 | A1 | 7/2017 | Okushima et al. | |
| 2017/0197419 | A1 | 7/2017 | Okushima et al. | |
| 2017/0274647 | A1 | 9/2017 | Aoki et al. | |
| 2017/0326875 | A1 | 11/2017 | Nakakubo et al. | |
| 2018/0043688 | A1 | 2/2018 | Okushima et al. | |
| 2019/0001697 | A1 | 1/2019 | Yamada et al. | |
| 2019/0009535 | A1 | 1/2019 | Osaki et al. | |
| 2019/0009541 | A1 | 1/2019 | Kondo et al. | |
| 2019/0009543 | A1 | 1/2019 | Yoshii et al. | |
| 2019/0009560 | A1 | 1/2019 | Kubo et al. | |

* cited by examiner

LIQUID EJECTION HEAD AND RECORDING APPARATUS

BACKGROUND OF THE INVENTION

Field of the Invention

The present invention relates to a liquid ejection head for ejecting liquid and a recording apparatus including the same.

Description of the Related Art

Page wide type (line type) liquid ejection apparatuses having a broad page wide type liquid ejection head that can accommodate the entire width of the recording medium in use (to be referred to as "page wide type head" hereinafter) and being adapted to carry and drive the recording medium for the recording operation while holding the page wide type head in an immobile state are known. Page wide type liquid ejection apparatuses can execute a recording operation at a speed higher than the speed at which serial type liquid ejection apparatuses can execute a recording operation, while scanning the recording medium. Since the page wide type head of a page wide type liquid ejection apparatus has a very large number of ejection ports if compared with the liquid ejection head (to be referred to as "serial head" hereinafter) that a serial type liquid ejection apparatus has and executes a recording process by a single scanning operation, it is important for the page type head to prevent any ejection failure from taking place due to liquid thickening in any of the ejection ports.

Known techniques for preventing ejection failures include the use of a circulation system for circulating liquid in a liquid ejection apparatus. With a circulation system, liquid is supplied from the liquid ejection apparatus main body to the supply inlet of the page wide type head and then forced to flow back from the supply outlet of the page wide type head to the liquid ejection apparatus main body by way of the internal flow paths of the page wide type head. Generally, page wide type heads are provided in the internal flow paths thereof with a filter for removing foreign objects such as small pieces of garbage and preventing garbage clogging of any of the ejection ports from taking place. Such a filter catches not only foreign objects but also minute bubbles in liquid. As the filter is covered by minute bubbles, the flow of liquid will be adversely affected by the bubbles. Therefore, a technique of purging the filter by removing minute bubbles is required so as to prevent the filter from being covered by minute bubbles.

Japanese Patent Application Laid-Open No. 2011-224936 describes a liquid ejection head having a vertically arranged filter whose lower part is dipped in liquid. The disclosed liquid ejection head is provided with an exhaust path arranged at the upstream side relative to the filter to discharge bubbles and the appearance of the phenomenon that the surface of the filter is covered by minute bubbles is suppressed by automatically opening and subsequently closing the exhaust path when air is accumulated there by means of a buoy.

If compared with serial heads, page wide type heads require a large volume of liquid to be ejected and, if compared with non-circulation systems, circulation systems also require a large volume of liquid. Thus, a relatively large volume of liquid flows in a page wide type head having a circulation system. Then, accordingly, the amount of foreign objects and minute bubbles that are caught by the filter increases. With the known technique described in Japanese Patent Application Laid-Open No. 2011-224936, the filter can be covered by foreign objects and minute bubbles to adversely affect the liquid flow through the filter as the amount of foreign objects and minute bubbles that are caught increases.

SUMMARY OF THE INVENTION

The present invention is made in view of the above identified problems. Thus, the object of the present invention is to provide a page wide type liquid ejection head having a circulation system to which a large amount of liquid is supplied and that can suppress any adverse effect of foreign objects and minute bubbles on the liquid flow through the filter in the liquid flow path and also a recording apparatus including such a page wide type liquid ejection head.

In the first aspect of the present invention, there is provided a page wide type liquid ejection head including a plurality of element substrates being arranged in the liquid ejection head, each of the element substrates having an ejection port for ejecting liquid, a pressure chamber equipped in the inside thereof with an energy generating element which generates energy for ejecting liquid, a supply flow path for supplying liquid to the pressure chamber and recovery flow path for recovering liquid from the pressure chamber, wherein, in a supply flow path for supplying liquid to the element substrates, a filter chamber having a filter for catching a foreign object contained in liquid is provided, in operation, the filter being arranged to intersect the vertical direction, the liquid being driven to flow from downward to upward relative to the filter.

In the second aspect of the present invention, there is provided a page wide type liquid ejection head including a plurality of sequentially arranged element substrates, each of the element substrates having an ejection port for ejecting liquid, a pressure chamber equipped in the inside thereof with an energy generating element which generates energy to be used for ejecting liquid, a supply flow path for supplying liquid to the pressure chamber and a recovery flow path for recovering liquid from the pressure chamber, wherein, in a supply flow path for supplying liquid to the element substrate, a filter chamber having a filter for catching a foreign object contained in liquid, a lower cell arranged downward relative to the filter and an upper cell arranged upward relative to the filter is provided, and liquid is forced to flow through the lower cell, the filter and the upper cell, the supply flow path, the pressure chamber and the recovery flow path in the above mentioned order.

Further features of the present invention will become apparent from the following description of exemplary embodiments with reference to the attached drawings.

DESCRIPTION OF THE EMBODIMENTS

Now, presently preferable embodiments of the present invention will be described below by referring to the accompanying drawings. Throughout the drawings, components having the same functions are denoted by the same reference symbols and may not be described repeatedly.

First Embodiment

Figure 1:
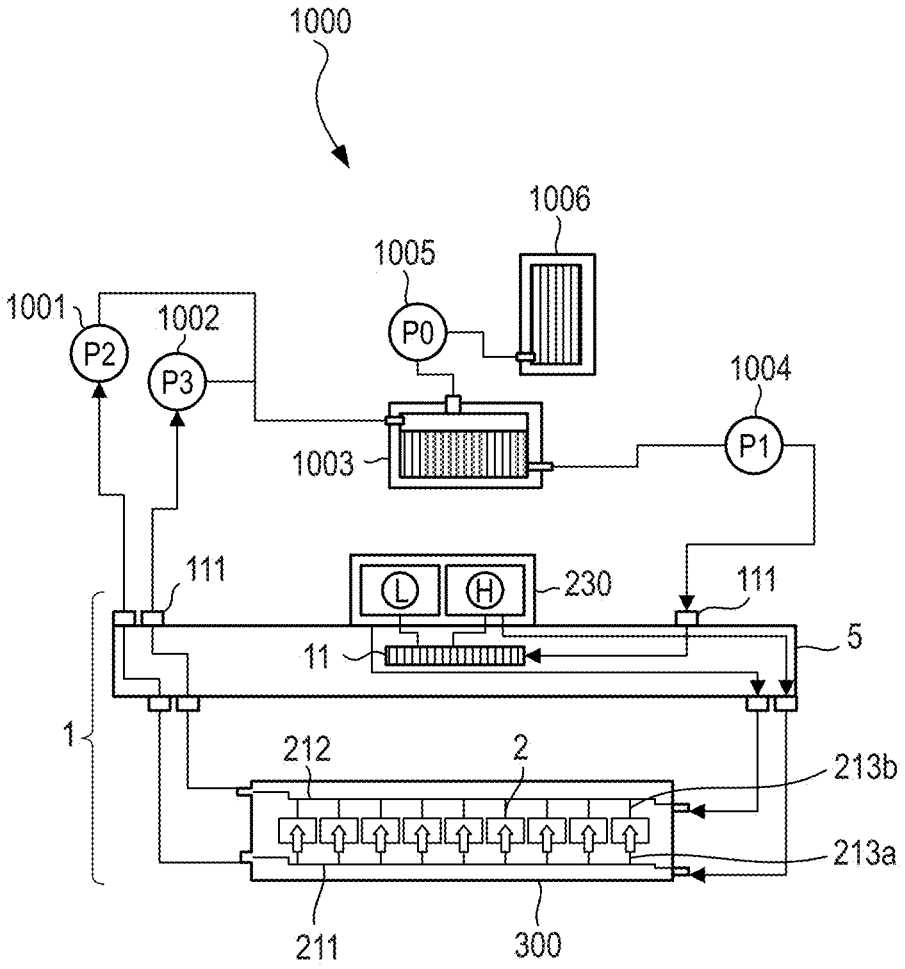
FIG. 1 is a schematic view of the first embodiment of liquid ejection apparatus according to the present invention, illustrating the configuration thereof.

FIG. 1 is a schematic view of the first embodiment of liquid ejection apparatus according to the present invention, illustrating the configuration thereof. More specifically, FIG. 1 schematically illustrates an exemplar arrangement of the circulation route for circulating liquid in the liquid ejection apparatus. Note that the liquid ejection apparatus 1000 shown in FIG. 1 is an inkjet recording apparatus adapted to execute recording operations by ejecting ink as liquid.

The liquid ejection apparatus 1000 includes a page wide type liquid ejection head 1. The liquid ejection head 1 can operate for full color printing, using CMYK (cyan, magenta, yellow and black) inks as liquid.

The liquid ejection head 1 is fluidly connected to first circulation pump (high pressure side) 1001, first circulation pump (low pressure side) 1002, buffer tank 1003 and so on. While FIG. 1 shows only the circulation route of one of the inks of the four colors of CMYK for simplicity of explanation, actually circulation routes for inks of the four colors are arranged in the liquid ejection head 1 and accordingly in the liquid ejection apparatus 1000.

Referring to FIG. 1, the buffer tank 1003 that operates as sub tank is connected to main tank 1006. The buffer tank 1003 has an atmosphere communication port (not shown) that is held in communication with the atmosphere and allows the inside of the tank to communicate with the outside of the liquid ejection apparatus 1000 so that bubbles in the tank can be discharged to the outside. The buffer tank 1003 is further connected to replenishing pump 1005. The replenishing pump 1005 operates to transfer liquid, or ink, from the main tank 1006 to the buffer tank 1003 to compensate for the amount of liquid that is consumed by the liquid ejection head 1 in an operation of ejecting or discharging liquid from the ejection ports of the liquid ejection head 1. An operation of ejection or discharging liquid may typically be a recording operation or an operation of suction compensation.

The two first circulation pumps 1001 and 1002 have a function of drawing liquid from liquid connecting sections 111 of the liquid ejection head 1 and flowing the drawn liquid to the buffer tank 1003. Preferably, the first circulation pumps are positive displacement pumps having quantitative liquid transporting capabilities. While specific examples of pumps that can be used as the first circulation pumps include tube pumps, gear pumps, diaphragm pumps and syringe pumps, ordinary pumps that are adapted to secure a constant flow rate by fitting a constant flow valve or a relief valve to the pump outlet may also be used as the first circulation pumps for the purpose of the present invention. When the liquid ejection head 1 is driven to operate, liquid is driven to flow at a constant flow rate through common supply path 211 and also through common recovery path 212, respectively, by the first circulation pump (high pressure side) 1001 and the first circulation pump (low pressure side) 1002. The flow rate is preferably so selected as to be not lower than a predetermined level so that the temperature differences among the element substrates (recording element substrates) 2 in the liquid ejection head 1 may not adversely affect the image quality of the recorded images. On the other hand, however, when a too high flow rate is selected, the recorded image can show an uneven image density because the negative pressure differences among the element substrates 2 become too large under the influence of the pressure losses in the flow paths in the liquid ejection units 300. For this reason, therefore, the flow rate is preferably selected by taking the temperature differences and the negative pressure differences among the element substrates into consideration.

For ink of each of given colors, a negative pressure control unit 230 is arranged on the circulation route between the second circulation pump 1004 and the liquid ejection unit 300 to control the negative pressure at the downstream side relative to the negative pressure control unit 230. More specifically, the negative pressure control unit 230 operates to confine the pressure at the downstream side relative to the negative pressure control unit 230 within a preset range that is centered at a desired pressure level even when the flow rate in the circulation route fluctuates due to the difference of recording duty. The downstream side relative to the negative pressure control unit 230 is the side located closer to the liquid ejection unit 300 than to the negative pressure control unit 230. The negative pressure control unit 230 is equipped with two pressure regulation mechanisms in which respective control pressures that are different from each other are preset. The two pressure regulation mechanisms are not subject to any particular limitations provided that each of them can control the pressure at the downstream side relative to itself and confine fluctuations of the pressure within a predetermined range that is centered at the preset pressure level. So called "pressure reducing regulators" can be adopted for the pressure regulation mechanisms. When pressure reducing regulators are employed for the pressure regulation mechanisms, preferably the upstream side of the negative pressure control unit 230 is pressurized by means of the second circulation pump 1004 by way of liquid supply unit 5. If such is the case, the influence of the water head pressure of the buffer tank 1003 relative to the liquid ejection head 1 can be controlled so that the degree of freedom of the layout of the buffer tank 1003 in the liquid ejection apparatus 1000 can be raised. The second circulation pump 1004 is only required to show head pressure not lower than a predetermined pressure level within the allowable variable range of ink circulation flow rate for the operation of the liquid ejection head 1. For instance, a turbo-type pump or a positive displacement pump can be used for the second circulation pump 1004. Specifically, a diaphragm pump or the like is used as the second circulation pump 1004. Furthermore, the second circulation pump 1004 may be replaced, for example, by a water head tank that is arranged to show a predetermined water head difference relative to the negative pressure control unit 230.

The liquid supply unit 5 is provided with a filter 11 for a color ink that communicates with the openings of the liquid connecting sections 111 in order to remove the foreign objects contained in the supplied liquid.

Of the two pressure regulation mechanisms, the mechanism where relatively high pressure is preset and the mechanism where relatively low pressure is preset are respectively connected to the common supply path 211 and the common recovery path 212 in the liquid ejection unit 300 by way of the inside of the liquid supply unit 5. In FIG. 1, the mechanism where relatively high pressure is preset is indicated by H whereas the mechanism where relatively low pressure is preset is indicated by L. For each of color inks of the different colors of CMYK, the common supply path 211, the common recovery path 212, individual supply paths 213*a* and individual recovery paths 213*b*, of which the individual supply paths 213*a* and the individual recovery paths 213*b* communicate with the related recording element substrates, are arranged in the liquid ejection unit 300. The individual flow paths (the individual supply paths 213*a* and the individual recovery paths 213*b*) are held in communication with the common supply path 211 and the common recovery path 212. With this arrangement, there arise flows (as indicated by arrows in FIG. 1) of part of the liquid flowing through the common supply path 211 starting from the common supply path 211, passing through the inside of the element substrates 2 and then getting into the common recovery path 212. This is because the mechanism where relatively high pressure is preset is connected to the common supply path 211 and the mechanism where relatively low pressure is preset is connected to the common recovery path 212 and a pressure difference arises between the two common flow paths (the common supply path 211 and the common recovery path 212).

As described above, liquid passes through the common supply path 211 and the common recovery path 212 and there also arise flows of part of the liquid that pass through the related element substrates 2. For this reason, the heat generated in the element substrate 2 can be discharged to the outside of the element substrates 2 by means of the liquid flowing through the common supply path 211 and the common recovery path 212. Additionally, because of this arrangement, flows of liquid are produced in the ejection ports and the pressure chambers that do not take part in the ongoing recording operation to suppress any undesired increase of viscosity that can otherwise take place at those sites. Furthermore, thickened liquid, if any, and the foreign objects contained in the liquid can be discharged to the common recovery path 212. Thus, the liquid ejection head 1 of this embodiment can record high quality images at high speed.

Figure 2:
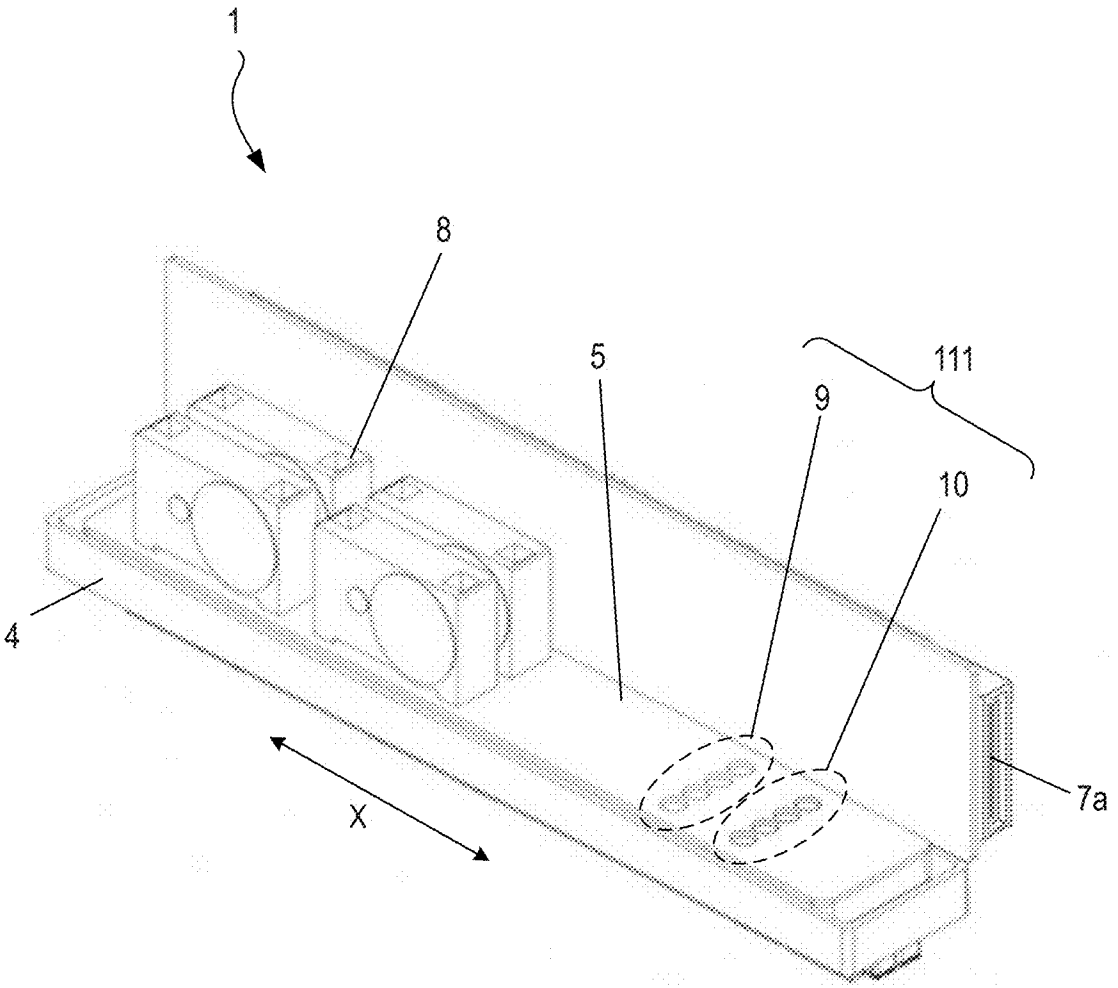
FIG. 2 is a schematic perspective view of the first embodiment of liquid ejection head according to the present invention as viewed from an obliquely upward position.
Figure 3:
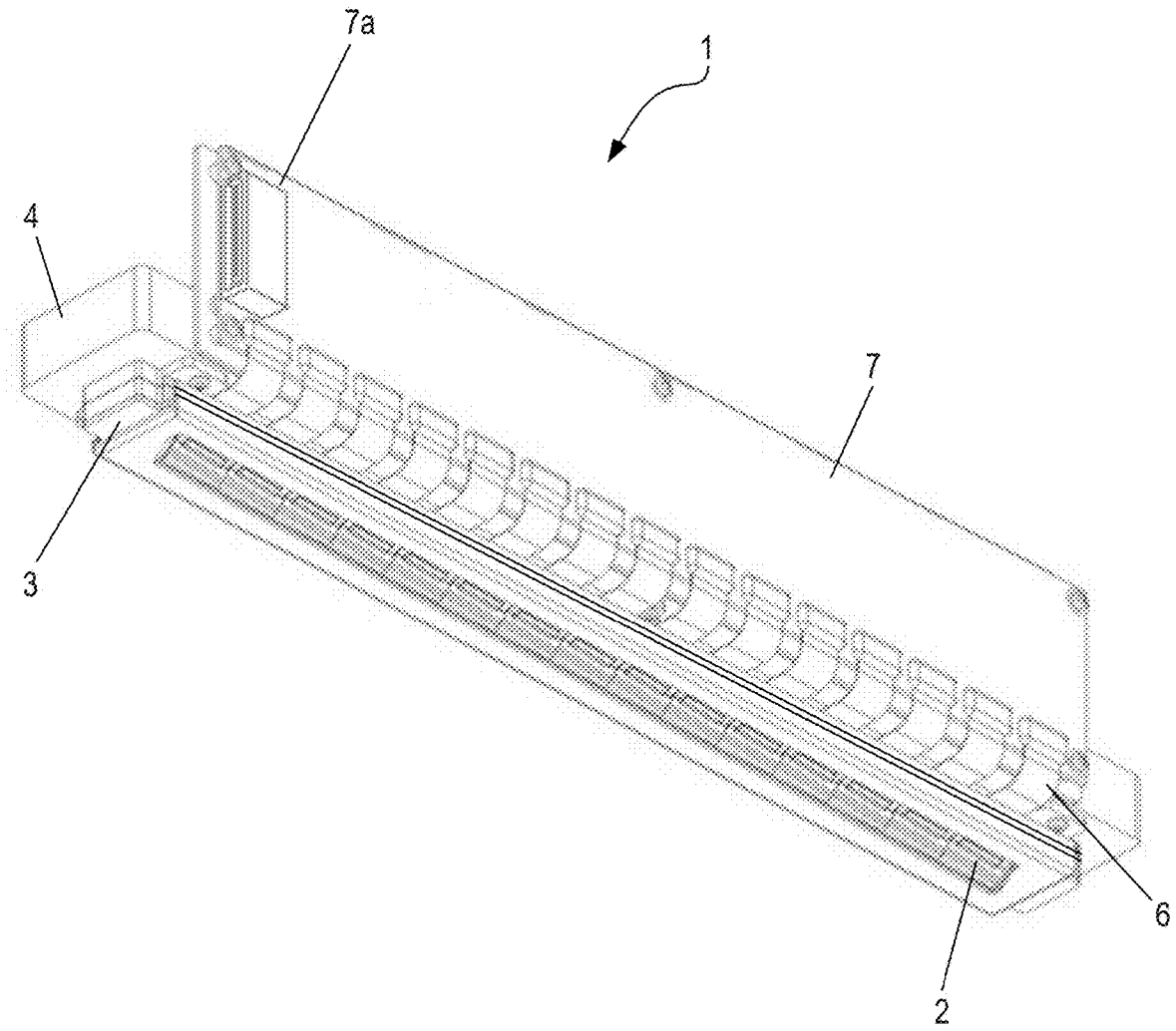
FIG. 3 is a schematic perspective view of the first embodiment of liquid ejection head according to the present invention as viewed from an obliquely downward position.

FIGS. 2 and 3 are schematic perspective views of the liquid ejection head 1. More specifically, FIG. 2 is a schematic perspective view of the liquid ejection head 1 as viewed from an obliquely upward position and FIG. 3 is a schematic perspective view of the liquid ejection head 1 as viewed from an obliquely downward position.

As shown in FIGS. 2 and 3, the liquid ejection head 1 includes, for each color ink, element substrates 2 for ejecting liquid, a flow path member 3 supporting the plurality of element substrates 2, a support member 4 that is a cabinet supporting the flow path member 3 and a liquid supply unit 5 for supplying liquid to the element substrates 2. In the illustrated instance, a total of fifteen element substrates 2 are shown.

Each of the element substrates 2 can eject ink of one of the four colors of CMYK as liquid. The element substrates 2 are electrically connected to a single circuit substrate 7 by way of respective separate flexible wiring substrates 6. The flexible wiring substrates 6 input the logic signals coming from the circuit substrate 7 to the element substrates 2. The element substrates 2 eject liquids by driving energy generating elements (not shown) according to the logic signals input to it. An electric connector 7*a* is arranged on the circuit substrate 7 to connect the circuit substrate 7 to the main body of the liquid ejection apparatus 1000. The electric connector 7*a* is fitted to near the edge of the circuit substrate 7 that is to be fitted to the main body of the liquid ejection apparatus 1000 out of the longitudinal edges of the circuit substrate 7, the longitudinal direction being the X-direction.

The plural element substrates 2 are substantially linearly arranged on the flow path member 3. The flow path member 3 has internal flow paths (not shown) for distributing (supplying) the liquid supplied from the liquid supply unit 5 to the individual element substrates 2. The support member 4 supports the flow path member 3 and the liquid supply unit 5.

Sub tanks 8 that operate as negative pressure control units 230 shown in FIG. 1 are arranged in the liquid supply unit 5. A total of four sub tanks 8 are provided so as to temporality store respective inks of different colors. Each of the liquid supply units 5 has a circulation inlet 9 that operates as supply inlet to which liquid is supplied from the liquid ejection apparatus 1000 and a circulation outlet 10 for circulating liquid relative to the main body of the liquid ejection apparatus 1000. The circulation inlet 9 and the circulation outlet 10 correspond to the liquid connecting sections 111 shown in FIG. 1.

Figure 4:
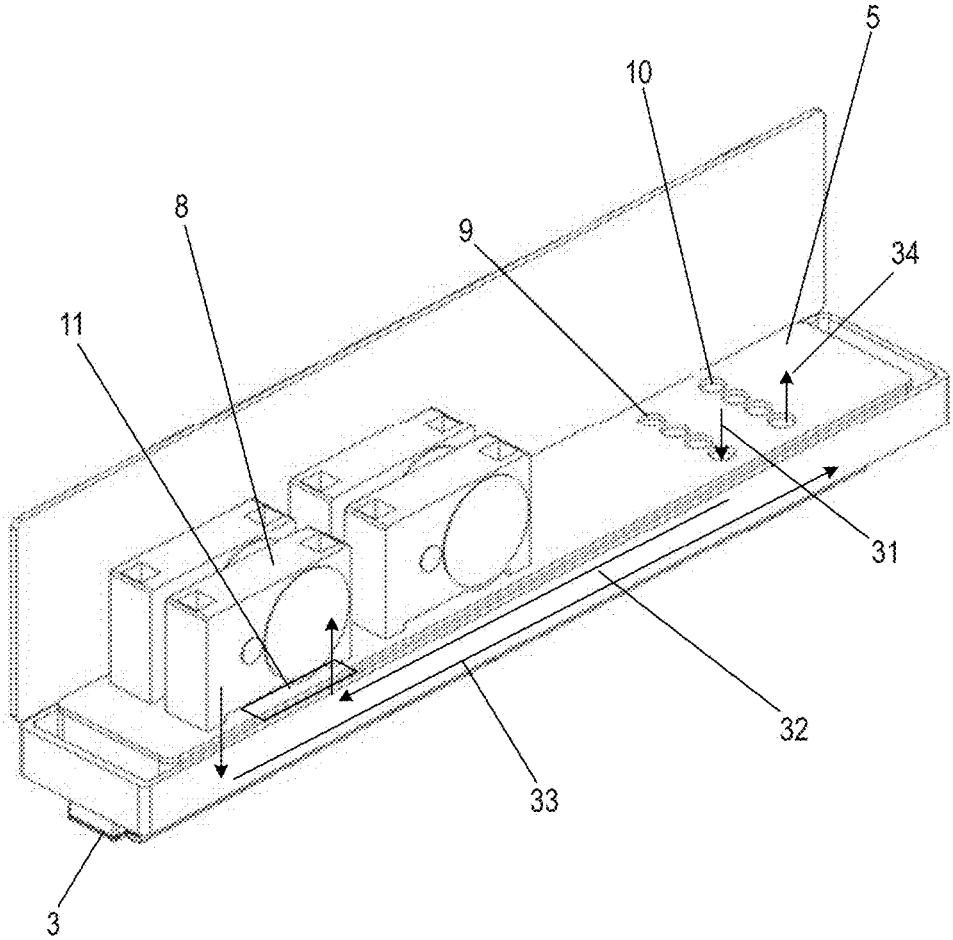
FIG. 4 is a schematic illustration of the flow of liquid in the first embodiment of liquid ejection head according to the present invention.
Figure 5:
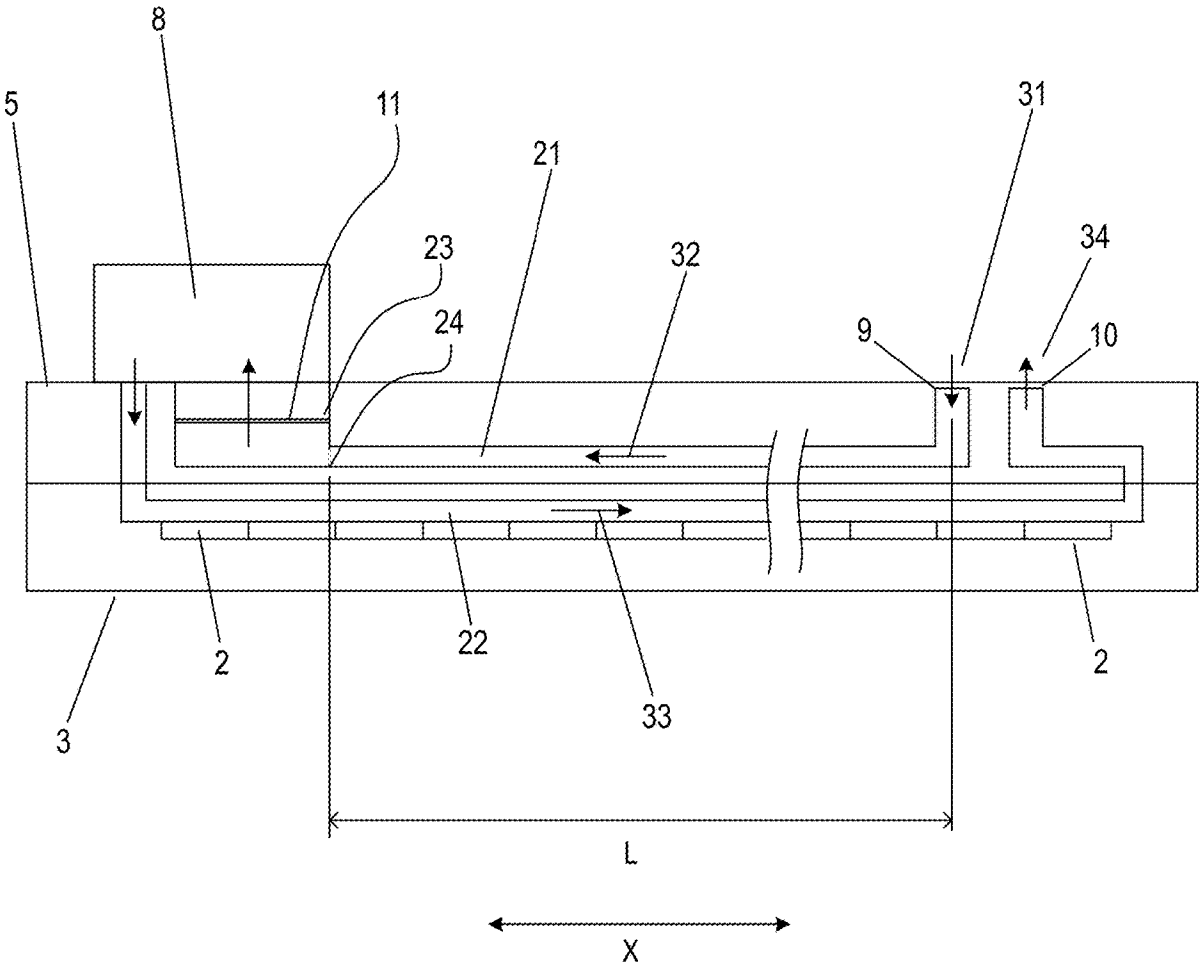
FIG. 5 is a schematic illustration of the liquid supply system of the first embodiment of liquid ejection head according to the present invention.

FIG. 4 is a schematic illustration of the flow of liquid of one of the different colors to be used for the ongoing recording operation in the liquid ejection head 1. FIG. 5 is a schematic illustration of the liquid supply system for supplying liquid to the individual element substrates 2 of the first embodiment of liquid ejection head 1.

As shown in FIG. 5, the liquid ejection head 1 has upstream supply path 21 that operates as internal flow path for flowing the liquid supplied to the circulation inlet and communicates with the circulation inlet 9 and downstream supply path 22 that communicates with the circulation outlet 10.

The upstream supply path 21 is arranged along the X-direction that is the longitudinal direction of the liquid ejection head 1, in the inside of the liquid supply unit 5. The end of the upstream supply path 21 that is opposite to the end connected to the circulation inlet 9 is held in communication with (connected to) filter chamber 23 More specifically, the filter chamber 23 is provided with a connection port 24 for supplying liquid to the filter chamber 23 and the upstream supply path 21 is held in communication with the filter chamber 23 by way of the connection port 24.

Filter 11 is arranged in the filter chamber 23 in order to catch (remove) the foreign objects (e.g. small pieces of garbage) contained in the liquid that passes through it. The filter 11 may be a mesh member typically formed by means of SUS (stainless steel). In this embodiment, the filter 11 is arranged substantially horizontally along the X-direction. More specifically, when the liquid ejection head 3 is in operation, the filter 11 is arranged in a direction that intersects (more specifically orthogonally intersects) the vertical direction so as to allow liquid to flow from downward to upward relative to the filter 11.

The filter chamber 23 is held in communication with the related one of the sub tanks 8. Desirably, the sub tank 8 is arranged at the upstream side relative to the substrate elements 2 and at the downstream side relative to the filter chamber 23 as shown in FIG. 5 in order to minimize the influence of negative pressure fluctuations on the element substrates 2 (more specifically to the ejection ports) due to pressure losses that may occur in the filter 11. Desirably, each of the sub tanks 8 is arranged such that it can store the bubbles that pass through the filter 11 in the related filter chamber 23 in order to minimize the outflow of extremely minute bubbles that pass through the filter 11 and flow to the ejection ports. For this reason, the sub tank 8 is desirably arranged above the filter chamber 23 as shown in FIG. 5.

The sub tank 8 can be made to operate for controlling the negative pressure typically by means of a bagged spring structure. The outlet of the sub tank 8 is held in communication with the downstream supply path 22. The downstream supply path 22 is arranged along the X-direction, which is the longitudinal direction of the liquid ejection head 1, in the inside of the flow path member 3. One of the opposite ends of the downstream supply path 22 in the X-direction is held in communication with the circulation outlet 10 while the other end is held in communication with the outlet of the sub tank 8. The downstream supply path 22 communicates with a plurality of individual flow paths 213 arranged for each of the element substrates 2 and also with the related one of the element substrates 2 by way of the individual flow paths 213.

Now, the flow of liquid that circulates in the liquid ejection head 1 when the liquid ejection head 1 is being driven for a recording operation will be described below.

As shown in FIGS. 4 and 5, for liquid of each of the different colors to be used for the ongoing recording operation, the liquid supplied from the main body of the liquid ejection apparatus 1000 flows into the circulation port 9 as supply flow 31 and then through the upstream supply path 21 as upstream liquid flow 32. The upstream liquid flow 32 flows to the filter chamber 23 by way of the connection port 24 and passes through the filter 11 from downward to upward so as to flow into the sub tank 8. The upstream liquid flow 32 that flows into the sub tank 8 then flows further into the downstream supply path 22 as downstream liquid flow 33. The liquid of the downstream liquid flow 33 is distributed to the element substrates 2 on the way of flowing through the downstream supply path 22 by way of the individual flow paths 213. Then, part of the liquid is ejected from the ejection ports and the rest joins the downstream liquid flow 33 once again. The downstream liquid flow 33 is then recovered to the main body of the liquid ejection apparatus 1000 from the circulation outlet 10 as return flow 34.

Note that, with the arrangement shown in FIGS. 4 and 5, the liquid distributed to the element substrates 2 from the downstream supply path 22 is returned to the same downstream supply path 22. However, an arrangement that causes the liquid distributed to the element substrates 2 from the common supply path 211 to flow into the communication recovery path 212 by using the common supply path 211 and the common recovery path 212 to form the downstream supply path 22 as shown in FIG. 1 may alternatively be employed.

Figure 6:
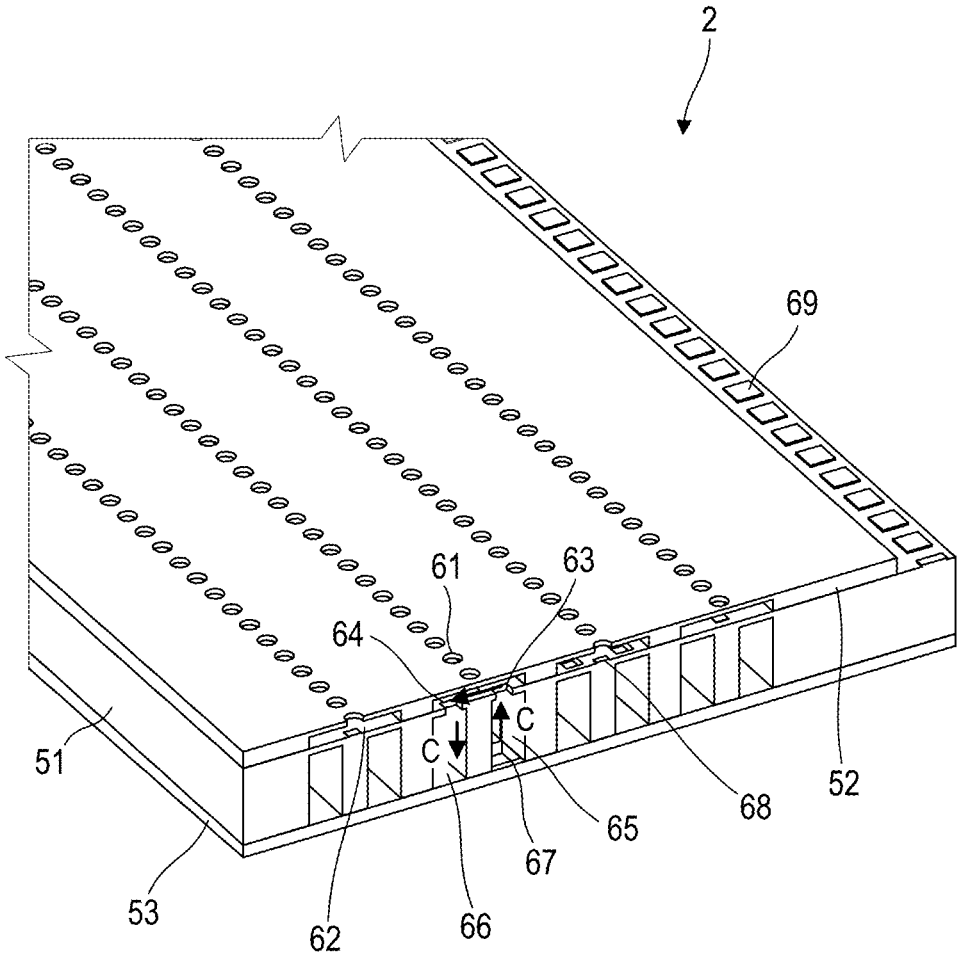
FIG. 6 is a schematic illustration of the flow of liquid in one of the element substrates of the first embodiment of liquid ejection head according to the present invention.

FIG. 6 is a schematic illustration of the flow of liquid in one of the element substrates 2. FIG. 6 shows a cross-sectional view of the element substrate 2. As shown in FIG. 6, the element substrate 2 is formed by laying ejection port forming member 52 on substrate 51 and lid member 53 is bonded to the surface of the substrate 51 opposite to the surface on which the ejection port forming member 52 is laid.

Ejection ports 61 for ejecting liquid are arranged in rows that run in a predetermined direction. The ejection port forming member 52 additionally has pressure chambers 62 arranged at positions located vis-à-vis the respective ejection ports 61 to store the liquid to be ejected from the ejection ports 61, supply ports 63 to which liquid is supplied and recovery ports 64 for recovering liquid.

Liquid supply paths 65 and liquid recovery paths 66 are formed in the substrate 51 and the lid member 53 so as to extend along the rows of ejection ports 61. The liquid supply paths 65 are supply paths for supplying liquid to the pressure chambers 62 by way of the supply ports 63, whereas the liquid recovery paths 66 are recovery paths for recovering liquid from the pressure chambers 62 by way of the recovery ports 64. The liquid supply paths 65 and the liquid recovery paths 66 are held in communication with the downstream supply path 22 shown in FIG. 5 by way of the openings 67 arranged at the lid member 53 and the individual flow paths 213 shown in FIG. 1.

The substrate 51 is provided with energy generating elements 68 for generating energy to be used for ejecting liquid from the ejection ports 61, the energy generating elements 68 being respectively oppositely disposed relative to the corresponding ejection ports 61 with the respective pressure chambers 62 interposed between them. Plural terminals 69 to be electrically connected to the flexible wiring substrates 6 shown in FIG. 3 are arranged in the direction running in parallel with the rows of ejection ports 61 at one of the opposite ends of the substrate 51 as viewed in the direction transversal relative to the running direction of the rows of ejection ports 61.

In the liquid ejection head 1 having the above-described configuration, the liquid coming from the downstream supply path 22 flows through the openings 67, the liquid supply paths 65, the supply ports 63, the pressure chambers 62, the recovery ports 64, the liquid recovery paths 66 and the openings 67 and returns back to the downstream supply path 22, as indicated by arrows C. As the energy generating elements 68 are driven to operate according to the logic signals input to the terminals 69, the liquid in the pressure chambers 62 is ejected from the ejection ports 61.

Figure 7A:
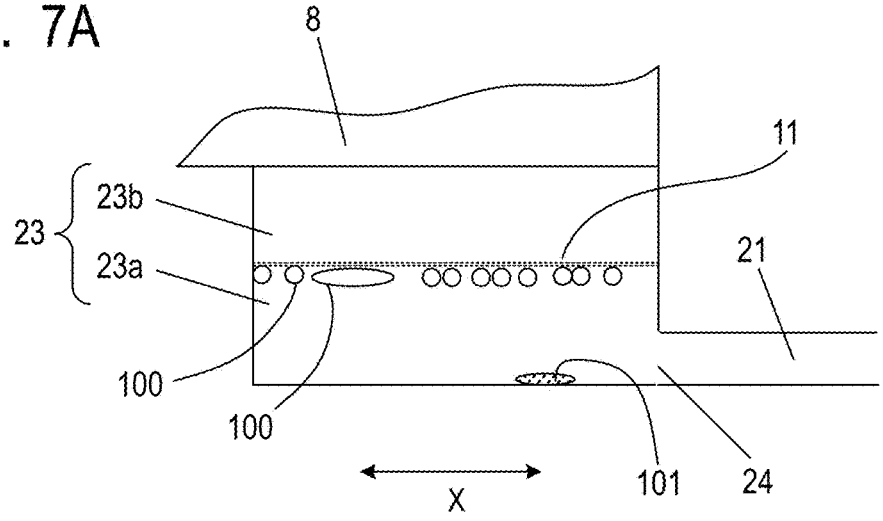
FIGS. 7A, 7B, and 7C are schematic illustrations of the internal behavior of one of the filter chambers of the first embodiment of liquid ejection head according to the present invention.
Figure 7B:
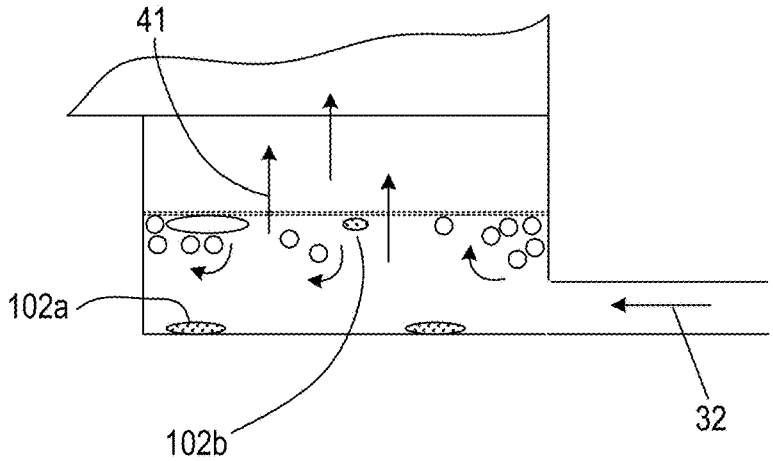
Figure 7C:
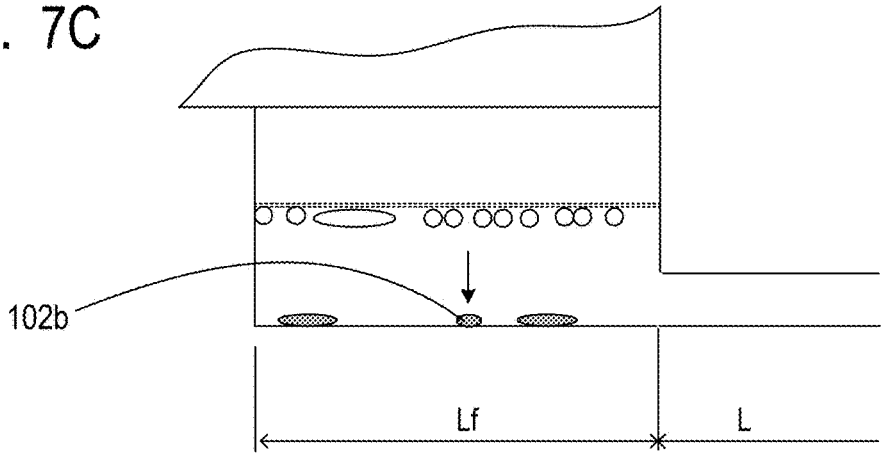

FIGS. 7A through 7C are schematic illustrations of the internal behavior of one of the filter chambers 23. As shown in FIGS. 7A through 7C, each of the filter chambers 23 is divided into a filter lower cell 23*a* arranged under the filter 11 and a filter upper cell 23*b* arranged on the filter 11. The filter lower cell 23*a* has a connection port 24 located at the lateral surface thereof as viewed in the longitudinal direction (the X-direction) of the liquid ejection head 1 and is held in communication with (connected to) the upstream supply path 21 by way of the connection port 24. The filter upper cell 23*a* is held in communication with the sub tank 8.

In an operation-suspended state where the circulation (flow) of liquid is suspended, minute bubbles (air bubbles) 100 and small pieces of garbage (foreign objects) 101 that have been brought in with circulating liquid are accumulated in the filter lower cell 23*a* as shown in FIG. 7A. While the accumulated minute bubbles 100 are held in contact with the filter 11 because of their buoyancy, the small pieces of garbage 101 are normally accumulated on the bottom of the filter lower cell 23*a* by their own weights so that the effective area of the filter 11 can satisfactorily be secured.

Note that the effective area of the filter 11 is the area of the filter 11 that allows liquid to pass through it.

As liquid is driven to start to circulate as shown in FIG. 7B, liquid flows into the filter lower cell 23*a* from the upstream supply path 21 by way of the connection port 24. Then, liquid flows (passes) upward from below relative to the filter 11 and then flows out toward the sub tank 8 by way of the filter upper cell 23*b*. Thereafter, liquid is fed sequentially to the liquid supply path 65, the pressure chambers 62 and the liquid recovery path 66.

If a non-circulation system is adopted, liquid is driven to flow by the surface tension that is generated as liquid is ejected from the ejection ports 1 and hence the liquid flow is weak. For this reason, when a large amount of minute bubbles 100 are produced, the flowing liquid is divided by the minute bubbles 100 to make the filter-passing liquid flow 41 unstable.

To the contrary, when a circulation system is adopted as in this embodiment, liquid is forcibly driven to flow by the circulation/supply mechanism including the first circulation pumps 1001 and 1002 illustrated in FIG. 1. Then, as a result, the liquid flow can be made strong. Thus, minute bubbles 100 are diffused (moved) in the filter lower cell 23*a*. Therefore, if minute bubbles 100 are accumulated in the filter lower cell 23*a*, the appearance of the phenomenon that liquid is divided by the minute bubbles 100 to make the filter passing liquid flow 41 unstable can be suppressed.

Of the small pieces of garbage 102*a* and 102*b* that are additionally brought in, the minute pieces of garbage 102*b* are accumulated so as to adhere to the filter 11, and the relatively large pieces of garbage 102*a* are accumulated on the bottom of the filter lower cell 23*a*. Therefore, the amount of small pieces of garbage that cover the filter 11 can be reduced and hence the appearance of the phenomenon that the filter-passing liquid flow 41 becomes unstable can be suppressed.

When the circulation of liquid is suspended, the minute pieces of garbage 102*b* drop onto the bottom of the filter lower cell 23*a*, as illustrated in FIG. 7C.

In this embodiment, the filter 11 and the upstream supply path 21 extend in the X-direction, which is the longitudinal direction of the liquid ejection head 1, and juxtaposed relative to each other as shown in FIG. 5. For this reason, the sum of the filter length Lf that is the length of the filter 11 in the X-direction and the upstream supply path length L that is the length of the upstream supply path 21 in the X-direction cannot exceed the length of the liquid ejection head 1 in the X-direction. In other words, the filter length Lf and the upstream supply path length L show a tradeoff relationship (antinomy), meaning that when either of them is made long, the other one of them needs to be made short.

As the filter length Lf is made long, the surface area of the filter 11 can be made large to reduce the flow resistance of the filer 11. Additionally, as the surface area of the filter 11 is made large, minute bubbles 100 can be diffused over a larger region so that the appearance of the phenomenon that the filter-passing liquid flow 41 becomes unstable can further be suppressed.

In this embodiment, one of the opposite ends of the upstream supply path 21 is connected to the connection port 24 and the circulation inlet 9 is arranged at the other end so that the filter length Lf and the upstream supply path length L can be made long within the limited length of the liquid ejection head 1 in the X-direction. Then, with this arrangement, the upstream supply path lengths L of the plurality of upstream supply paths 21 that correspond to inks of the different colors can be differentiated and the plurality of filter chambers 23 that correspond to inks of the different colors can be arranged in parallel with each other in a direction that intersects the X-direction, while satisfactorily securing the filter length Lf. Thus, the degree of freedom of arrangement of each of the filters 11 can be raised.

Note that, operations of removing the minute bubbles 100 caught by the filter 11 and purging the filter 11 may be executed in this embodiment of liquid ejection apparatus 1000. The purging operation may typically be an operation of flowing liquid backward, in other words, flowing liquid downwardly from above to below relative to the filter 11, while the liquid ejection apparatus 1000 is not performing any recording operation. Alternatively, the purging operation may be an operation of flowing liquid at a speed faster than the speed at which liquid is made to flow during recording operations, while the liquid ejection apparatus 1000 is not performing any recording operation.

Thus, in this embodiment, each of the element substrates 2 includes ejection ports 61 for ejecting liquid, pressure chambers 62 for storing the liquid to be ejected from the ejection ports 61, liquid supply paths 65 for supplying liquid to the pressure chambers 62 and liquid recovery paths 66 for recovering liquid from the pressure chambers 62. Each of the filter chambers 23 is equipped with a filter 11 for seizing the foreign objects contained in the liquid that passes through the filter 11 and liquid flows upwardly from below relative to the filter 11.

Thus, with the above-described arrangement, relatively large foreign objects can be made to accumulate on the bottom of the filter chamber 11 so that the appearance of the phenomenon that the filter is covered by foreign objects can be suppressed if the amount of foreign objects increases. Additionally, since liquid can be recovered from the pressure chambers 62, the minute bubbles caught by the filter 11 can be diffused by increasing the strength of the liquid flow so that the appearance of the phenomenon that the filter 11 is covered by minute bubbles can be suppressed even when the amount of minute bubbles caught by the filter 11 increases. In other words, the normal liquid flow in the liquid ejection apparatus 1000 can be maintained even when the amount of foreign objects and that of minute bubbles increase and/or even when liquid is made to flow at an increased rate.

Second Embodiment

Figure 8A:
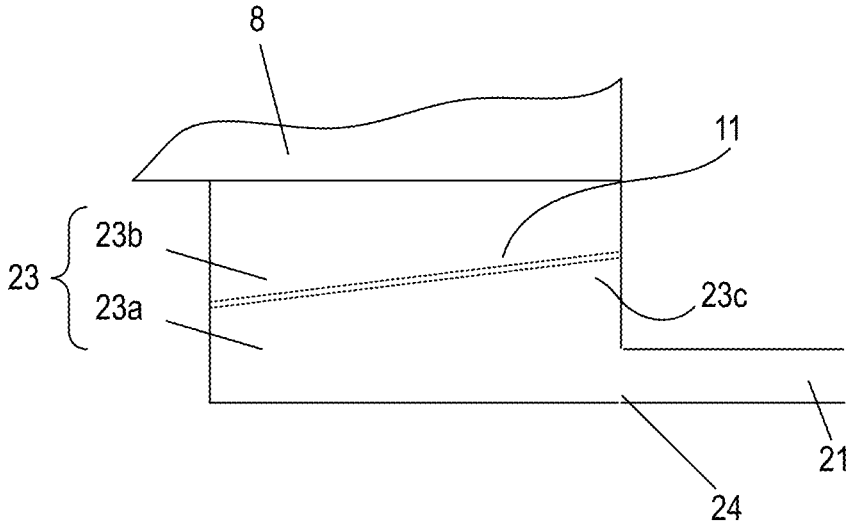
FIGS. 8A and 8B are schematic illustrations of the internal behavior of one of the filter chambers of the second embodiment of liquid ejection head according to the present invention.
Figure 8B:
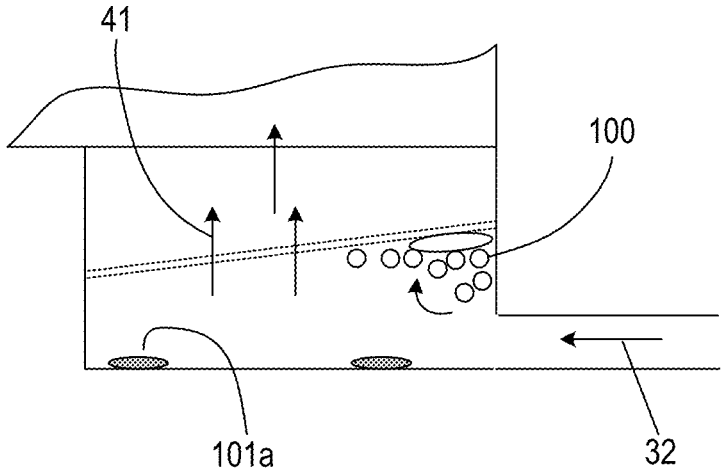

FIGS. 8A and 8B are schematic illustrations of one of the filter chambers 23 of the second embodiment of the present invention. In the filter chamber 23 shown in FIGS. 8A and 8B, the filter 11 is vertically inclined relative to the X-direction that is the longitudinal direction of the liquid ejection head 1. Then, as a result, a bubble gathering region 23*c* is formed at one of the opposite ends of the filter 11 as viewed in the X-direction that is located at a position higher than the position of the other end. As shown in FIG. 8B, the bubble gathering region 23*c* can store minute bubbles 100 when liquid is driven to circulate in the liquid ejection apparatus 1000. The filter-passing flow 41 flows in such a way as to avoid the bubble gathering region 23*c*.

A purging operation of removing minute bubbles 100 is preferably periodically executed because minute bubbles 100 can gradually be accumulated in the bubble gathering region 23*c*. For this operation, a bubble gathering region 23*c* is preferably provided in the filter lower cell 23*a* at the side where the connection port 24 is arranged (at a position located adjacent to the connection port 24). In other words, the filter 11 is preferably obliquely arranged so as to allow the side thereof closest to the connection port 24 in the longitudinal direction be arranged to be located higher than the opposite side. At this time, a strong flow of liquid that flows into filter chamber 23 from the upstream supply path 21 can be fed to the bubble gathering region 23*a* by flowing liquid for the purging operation at a speed faster than the speed at which liquid is made to flow in a recording operation. Then, the minute bubbles 100 accumulated in the bubble gathering region 23*a* are forced to pass through the filter 11 so that the minute bubbles can be discharged to the outside of the liquid ejection head 1 by way of the lower supply path 22 and the circulation outlet 10. Thus, minute bubbles 100 can easily be removed by the purging operation.

The configuration of each of the above-described embodiments is only an exemplary one and the present invention is by no means limited to the described configurations.

For example, a circulation system of circulating liquid between the liquid ejection head 1 and the outside of the liquid ejection head 1 is adopted in each of the above-described embodiments but some other circulation system may alternatively be adopted. For instance, two tanks including one arranged at the upstream side and one arranged at the downstream side of the liquid ejection head 1 may be provided and liquid may be made to flow from one of the tanks to the other tank so as to force the liquid in the pressure chambers 62 to flow. With such an arrangement, liquid is forced to flow to give rise to a strong liquid flow. Then, as a result, the appearance of the phenomenon that the filter is covered by minute bubbles can be suppressed if the amount of minute bubbles increases.

Additionally, in the second embodiment, the filter 11 may alternatively be so arranged that it is tilted in a direction that intersects the X-direction that is the longitudinal direction of the liquid ejection head 1.

According to the present invention, liquid is forced to flow upwardly from below relative to the filter and hence large foreign objects can be made to accumulate below the filter. Thus, the appearance of the phenomenon that the filter is covered by foreign objects can be suppressed if the amount of foreign objects that accumulate below the filter increases. Additionally, since liquid can be recovered from the pressure chambers, the minute bubbles that are caught by the filters can be diffused by intensifying the liquid flows in the liquid ejection apparatus even when the amount of minute bubbles increases. Then, the appearance of the phenomenon that the filter is covered by minute bubbles can be suppressed. Thus, the adverse effect of foreign objects and minute bubbles on the flow of liquid at the filters can be suppressed even in page wide type liquid ejection heads having a circulation system in which liquid is supplied at a high rate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-126306, filed Jun. 28, 2017, which is hereby incorporated by reference herein its entirety.

What is claimed is:

1. A page wide type liquid ejection head comprising a plurality of element substrates being arranged in the liquid ejection head, each of the element substrates having an ejection port for ejecting liquid, a pressure chamber equipped in the inside thereof with an energy generating element which generates energy for ejecting liquid, a chamber supply flow path for supplying liquid to the pressure chamber and a chamber recovery flow path for recovering liquid from the pressure chamber, the liquid ejection head comprising:

in an element substrate supply flow path for supplying liquid to the element substrates, a filter chamber having a filter for catching foreign objects contained in liquid, in operation, the filter being arranged to intersect a vertical direction, the liquid being driven to flow upwardly from below relative to the filter to pass through the filter; and a negative pressure control unit arranged at an upstream side relative to the element substrate and a downstream side relative to the filter chamber so as to maintain the liquid pressure at the downstream side relative to the negative pressure control unit within a predetermined range, wherein the negative pressure control unit has a sub tank arranged above the filter chamber, and wherein the filter is located at an upstream side of the element substrate.

2. The liquid ejection head according to claim 1, wherein the filter is arranged such that a long side of the filter extends along a longitudinal direction of the liquid ejection head.

3. The liquid ejection head according to claim 1, wherein the filter is arranged such that a long side of the filter is obliquely disposed relative to a longitudinal direction of the liquid ejection head.

4. The liquid ejection head according to claim 3, wherein the filter chamber has a connection port arranged at a side thereof in the longitudinal direction, the connection port being supplied with liquid; and the filter is arranged such that a side thereof closest to the connection port with respect to the longitudinal direction is arranged to be higher relative to remaining parts thereof.

5. The liquid ejection head according to claim 1, further comprising:

a supply inlet for receiving liquid supplied from outside, wherein the element substrate supply flow path is an upstream supply path arranged along a longitudinal direction to supply the liquid received by the supply inlet to the filter chamber.

6. The liquid ejection head according to claim 1, wherein the plurality of element substrates are arranged linearly along a longitudinal direction of the liquid ejection head.

7. The liquid ejection head according to claim 1, wherein the liquid supplied to the pressure chambers by way of the chamber supply flow paths is forced to circulate between the inside and the outside of the liquid ejection head by way of the chamber recovery flow path.

8. A recording apparatus comprising:

a page wide type liquid ejection head according to claim 1; and a pump for supplying liquid to the liquid ejection head wherein the filter chamber includes a lower cell arranged below the filter and an upper cell arranged above the filter and liquid is forced to flow through the lower cell, the filter, the upper cell, the chamber supply flow path, the pressure chamber, and the chamber recovery flow path in the listed order.

* * * * *